US009149706B2

(12) United States Patent
Mudgett

(10) Patent No.: US 9,149,706 B2
(45) Date of Patent: Oct. 6, 2015

(54) ADAPTABLE TRAINING PUTTER HEAD

(71) Applicant: F. Scott Mudgett, Del Mar, CA (US)

(72) Inventor: F. Scott Mudgett, Del Mar, CA (US)

( * ) Notice: Subject to any disclaimer, the term of this patent is extended or adjusted under 35 U.S.C. 154(b) by 0 days.

(21) Appl. No.: 14/249,311

(22) Filed: Apr. 9, 2014

(65) Prior Publication Data

US 2014/0309051 A1 Oct. 16, 2014

Related U.S. Application Data

(60) Provisional application No. 61/811,093, filed on Apr. 11, 2013.

(51) Int. Cl.
*A63B 69/36* (2006.01)
*A63B 53/06* (2015.01)

(52) U.S. Cl.
CPC ..... *A63B 69/3685* (2013.01); *A63B 53/065* (2013.01); *A63B 2210/50* (2013.01)

(58) Field of Classification Search
CPC ..... A63B 69/3685; A63B 2210/50; A63B 53/065
USPC ..... 473/236, 238
See application file for complete search history.

(56) References Cited

U.S. PATENT DOCUMENTS

| | | | | | |
|---|---|---|---|---|---|
| 3,021,141 | A * | 2/1962 | Polsky et al. | ..... | 473/236 |
| 3,273,892 | A * | 9/1966 | Nolting | ..... | 473/238 |
| 4,647,045 | A * | 3/1987 | Bilyeu | ..... | 473/238 |
| 4,953,867 | A * | 9/1990 | Rigsby | ..... | 473/238 |
| 5,011,153 | A * | 4/1991 | Watkins | ..... | 473/236 |
| 5,137,275 | A * | 8/1992 | Nelson | ..... | 473/306 |
| 5,595,543 | A * | 1/1997 | Wolk | ..... | 473/162 |
| 5,716,286 | A * | 2/1998 | Swan | ..... | 473/175 |
| 5,810,675 | A * | 9/1998 | Weathers | ..... | 473/236 |
| 5,924,935 | A * | 7/1999 | Prewitt | ..... | 473/236 |
| 6,827,655 | B2 * | 12/2004 | Burns | ..... | 473/236 |
| 7,247,102 | B2 * | 7/2007 | Hayd | ..... | 473/236 |
| 7,396,288 | B2 | 7/2008 | McLaughlin | | |
| 7,556,569 | B1 * | 7/2009 | Caserta | ..... | 473/236 |
| 7,614,960 | B2 * | 11/2009 | Miller et al. | ..... | 473/236 |
| 8,152,649 | B2 | 4/2012 | Bittner | | |
| 8,409,026 | B2 | 4/2013 | Riddle | | |
| 2002/0198060 | A1 * | 12/2002 | Fisher | ..... | 473/244 |
| 2006/0094521 | A1 * | 5/2006 | Burns | ..... | 473/236 |
| 2006/0276258 | A1 * | 12/2006 | McLaughlin | ..... | 473/236 |
| 2014/0309051 | A1 * | 10/2014 | Mudgett | ..... | 473/251 |

* cited by examiner

*Primary Examiner* — Sebastiano Passaniti
(74) *Attorney, Agent, or Firm* — IDP Patent Services; Olav M. Underdal

(57) ABSTRACT

An adaptable training putter head for use in a training putter includes an outer alignment guide, an inner alignment guide, and a sighting bar, all mounted to a conventional style putting head, to which is also attached a hosel, allowing for both right-handed and left-handed operation of a putting club. The adaptable training putter head allows a golf player to visually ensure that a putting club is oriented correctly during a putting swing, and is designed to improve accuracy during practice and recreational golf games. The adaptable training putter head can be used in a regulation conformant mode, with all alignment guides and sighting bar detached. A golf putter training clip-on device can include one or more alignment guides, a bridge, an elongator, and a clip, such that the golf putter clip-on device can be attached to a putter, with the elongator allowing for position and height adjustment.

18 Claims, 9 Drawing Sheets

ADAPTABLE TRAINING PUTTER HEAD

CROSS-REFERENCE TO RELATED APPLICATIONS

This application claims the benefit of U.S. Provisional Application No. 61/811,093, filed Apr. 11, 2013.

FIELD OF THE INVENTION

The present invention relates generally to the game of golf, and more particularly to the putting aspect of the game, and a special construction of the putting head of a golf putter, for the purpose of aiding the average recreational player in practice, training and normal game play.

BACKGROUND OF THE INVENTION

Many attempts have been made to improve golf putter design in order to increase accuracy and reliability during the putting phase of the game.

Various regulations, such as the Official USGA Rules of Golf concerning putter head design, limit the putter head designs for clubs to be used in officially sanctioned tournaments, handicapping and in other competitive game play.

This invention is not designed with a primary goal of conforming to such regulations. Several aspects of its configuration and use may not conform to regulations, while other aspects allow for operation in a mode with detached elements, so that the putting head attains conformance with applicable regulations.

Rather, the aim of the present invention is to create a new type of putter that will help golf players of average ability to improve their performance and personal enjoyment of golf, during both practice sessions and normal game play.

More specifically, this invention helps the player target putter alignment throughout the entire putting stroke, employing a design construction with such necessary strength and stability so that it can equally well be employed as a training putter on the practice putting green or during practice rounds on a golf course, or be used as a conventional putter during tournament play.

As such, considering the foregoing, it may be appreciated that there continues to be a need for novel and improved devices and methods for improving putting reliability and accuracy,

SUMMARY OF THE INVENTION

The foregoing needs are met, to a great extent, by the present invention, wherein in aspects of this invention, enhancements are provided to the existing model of putting head design.

In aspects of this invention a training putter can function as a new form of golf putter, which implements significant improvements for recreational and competitive golf play.

Firstly, the adaptable training putter head specifically disregards USGA putter regulations against having alignment features projecting forward of (and above) the clubface. The very reason that these features are disallowed for regulation golf is the same reason that they make putting with this training putter more fun—the forward projecting alignment guides make it much easier to direct the ball exactly where to go.

Secondly, in contrast to putting training aids designed for use solely on the putting green, the playability of the training putter's hybrid design, with conforming and non-conforming features, invites recreational golfers to 'train' or practice while playing on the course.

Thirdly, the adaptability of the training putter's features enable a golfer to not only polish and solidify his/her putting stroke, but also allow the golfer to easily convert the training putter to a regulation conform club for tournament golf.

In related aspects, the adaptable training putter head respects the fact that most golfers do not play golf strictly conforming to the USGA Rules of golf. By making the sinking of longer putts so very much easier, the adaptable training putter head makes recreational golf much more fun and rewarding, while improving the putting stroke overall.

In one aspect, this invention includes one or more of three semi-permanently attached visual aids, mounted on a conventional blade style putter head. These visual aids are held in place by fasteners, such as screws, and are thus removable, allowing for adaptable configuration of the putting head.

In a related aspect, the visual aids can include the following:

a) A top-mounted sighting bar, protruding up from the club head, which indicates the proper position and angulation of the putter head when making contact with the golf ball during the putting swing motion. The Official Rules of Golf prohibit a visual aid extending upward from the club head, and this sighting bar may therefore not be regulation conformant; and b) Two alignment guides, mounted on the toe and heel of the putter head, extending forward (and rearward) of the clubface. They are both mounted with a fastener, such as a simple screw. This allows them to be easily positioned in the reverse direction, reducing the amount of aid the guides provide. The Official Rules of Golf prohibit any visual aid extending forward of the club face, and these alignment guides may therefore not be regulation conformant.

In a related aspect, the sighting bar and the alignment guides can be easily removed, thereby converting the putter into a conventional style putter.

In a related aspect, the sighting bar can help a golf player position the putter head correctly behind the golf ball when the golf player is addressing the putt and before the putting stroke is executed. The sighting bar can also allow the player to visually confirm the direction of the intended put.

In a related aspect, the alignment guides can allow the player to visually ensure that the golf putter head is oriented correctly, by enabling the golfer to draw a mental image of two straight tracks that the alignment guides should follow during the entire evolution of a putting stroke along the intended putting line.

In another aspect, a golf putter training clip-on device can include:

a) Two alignment guides;

b) A bridge, such that the alignment guides connect on either end of the bridge, and are perpendicular to the bridge;

c) An elongator; which is perpendicularly connected to the bridge, such that the elongator is pointed upwards from the bridge;

d) A clip;

Such that the clip-on device can be attached to a putter by being clipped on to the hosel of the putter; where the elongator can allow for adjustment of the position of the clip-on device in relation to the head and hosel of the putter.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
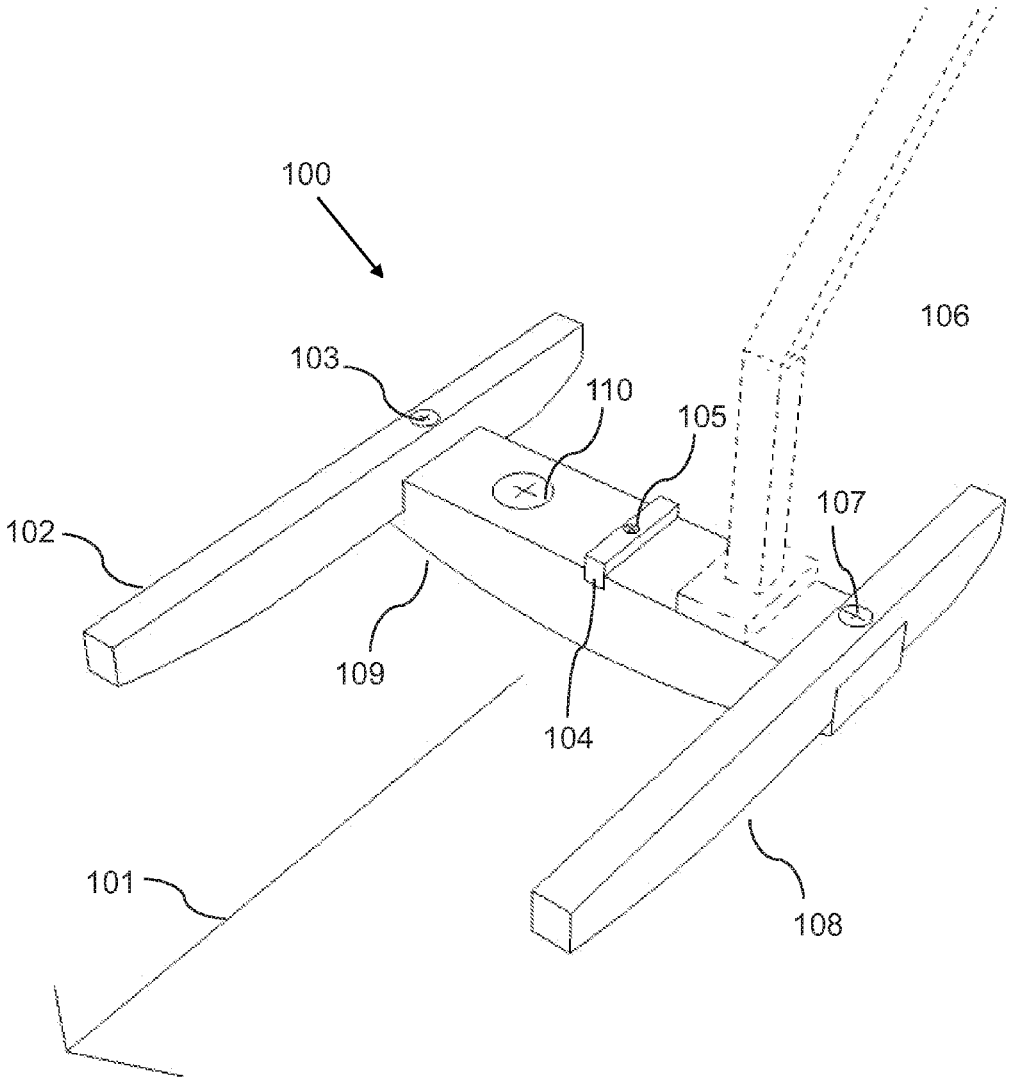
FIG. 1 depicts a top perspective view of an embodiment of the adaptable training putter head.

Before describing the invention in detail, it should be observed that the present invention resides primarily in a novel and non-obvious combination of elements and process steps. So as not to obscure the disclosure with details that will readily be apparent to those skilled in the art, certain conventional elements and steps have been presented with lesser detail, while the drawings and specification describe in greater detail other elements and steps pertinent to understanding the invention.

The following embodiments are not intended to define limits as to the structure or method of the invention, but only to provide exemplary constructions. The embodiments are permissive rather than mandatory and illustrative rather than exhaustive.

One embodiment of the adaptable training putter head describes a standard golf putter head, attached via a hosel, to a standard golf putter shaft, whereby this standard golf putter head is adapted to be mounted with a plurality of alignment devices.

In the following, the toe shall denote the far or outer end of the club head, in relation to the player, and correspondingly the heel shall denote the inner end, which is closest to the player. The face of the club head shall denote the part of the club head, which comes into direct contact with the golf ball, during a forward motion golf swing.

In the following, we describe the structure of an embodiment of the adaptable training putter head in reference to FIG. 1, in such manner that like reference numerals refer to like components throughout; a convention that we shall employ for the remainder of this specification.

An adaptable training putter head 100 can include:

a) a standard putting head 109;

b) an outer alignment guide 102, secured with a fastening mechanism 103, such as for example a screw; to the standard putting head 109; to which is further attached c) a sighting bar 104, secured with a fastening mechanism 105;

d) a hosel 106, attached with a bottom mounted fastening mechanism 201 (FIG. 2); and e) an inner alignment guide 108, attached with fastening mechanism 107, such as for example a screw; to the standard putting head 109, such that the inner alignment guide is mounted closer to the player.

whereby a golf player can adjust proper putter alignment throughout an entire putting stroke, by ensuring that the toe and heel mounted alignment guides 102, 108 are pointed in the intended putting target direction; and the sighting bar 104 can help a golf player position the putter head correctly behind the golf ball and further allow the golf player to visually confirm the direction of the intended put, when the golf player is addressing the putt and before the putting stroke is executed.

In a related embodiment, the outer alignment guide 102 can be toe mounted, such that the outer alignment guide 102 is mounted at the toe or substantially close to the toe of the standard putting head 109, such as illustrated on FIGS. 1-5.

In a related embodiment, the inner alignment guide 108 can be heel mounted, such that the inner alignment guide 108 is mounted at the heel or substantially close to the heel of the standard putting head 109, such as illustrated on FIGS. 1-5.

In various related embodiments, the alignment guides 102, 108 can be mounted in a plurality of configurations, including:

a. The alignment guides 102, 108 have a longer forward projection to the front of the standard putting head 109, and a shorter projection to the rear of the standard putting head 109, such as shown in FIGS. 1-5;

b. The alignment guides 102, 108 have a similar length forward projection to the front of the standard putting head 109, as to the rear of the standard putting head 109;

c. The alignment guides 102, 108 have a shorter forward projection to the front of the standard putting head 109, and a longer projection to the rear of the standard putting head 109;

d. The alignment guides 102, 108 have only a forward projection to the front of the standard putting head 109;

e. The alignment guides 102, 108 have only a projection to the rear of the standard putting head 109.

In a further related embodiment, a forward projecting part of each of the alignment guides 102, 108 can be detachable, such that after removal of the forward projecting parts, the alignment guides 102, 108 have only a projection to the rear of the standard putting head 109.

In a further related embodiment, a rearward projecting part of each of the alignment guides 102, 108 can be detachable, such that after removal of the rearward projecting parts, the alignment guides 102, 108 have only a projection to the front of the standard putting head 109.

In related embodiments, the standard putting head 109 can include a plurality of well-known traditional putting head design, including blade style, mallet style, and oversized style, as well as other types of putting heads. This can further include a plurality of shapes, grove designs, and weight distributions of the standard putting head 109.

FIG. 1 shows an adaptable training putter head in a right-handed configuration, with the direction of a normal putting target direction indicated by a directional arrow 101.

A further embodiment can include an alternative fastening aperture 110 for mounting the hosel 106 in left-handed a configuration.

Figure 2:
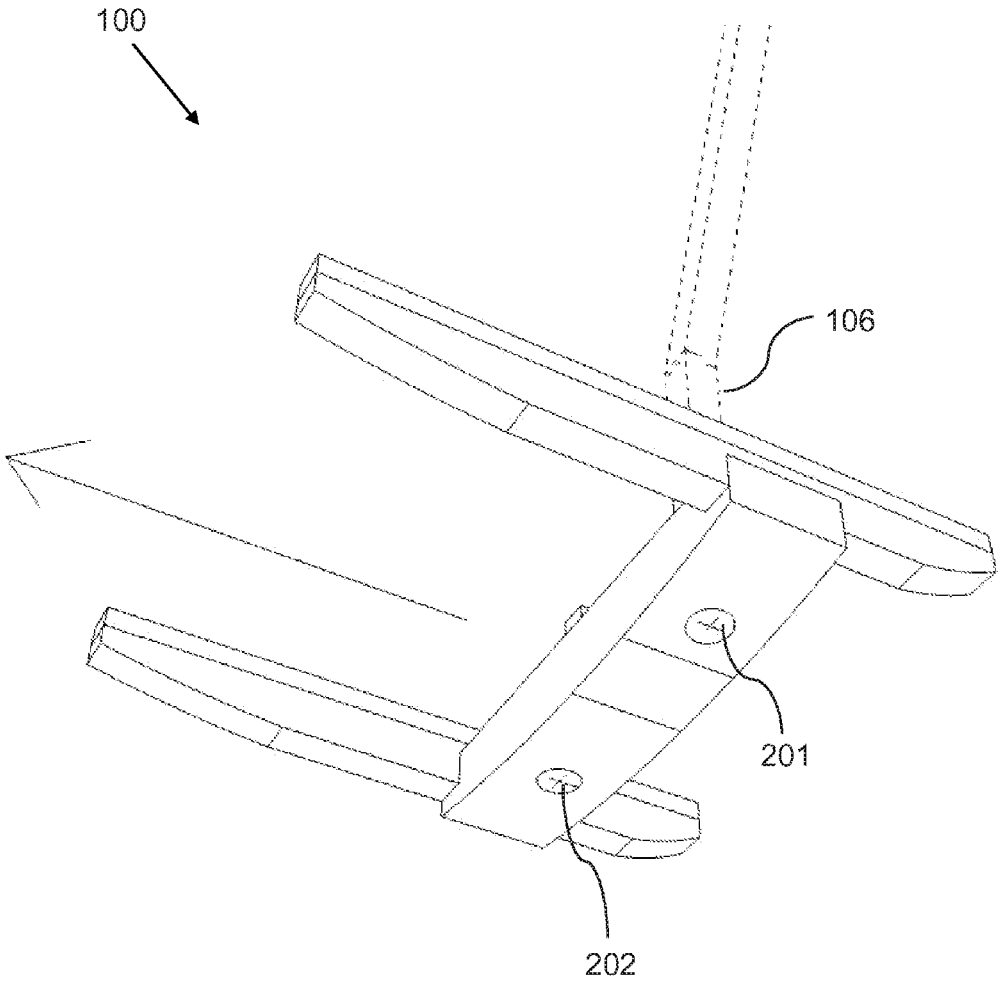
FIG. 2 depicts a bottom perspective view of an embodiment of the adaptable training putter head.

FIG. 2 shows a bottom-perspective view of an embodiment, indicating the fastening mechanism 201 for the hosel 106, in a configuration for right-handed play, and the alternative fastening aperture 202, for use in a configuration for left-handed play.

Further embodiments can include a plurality of alternative fastening mechanisms 103, 105, 107, 201, 202, which for example can include a screw, a bolt, a hand operated bolt, or a snap lock fastener.

Figure 3:
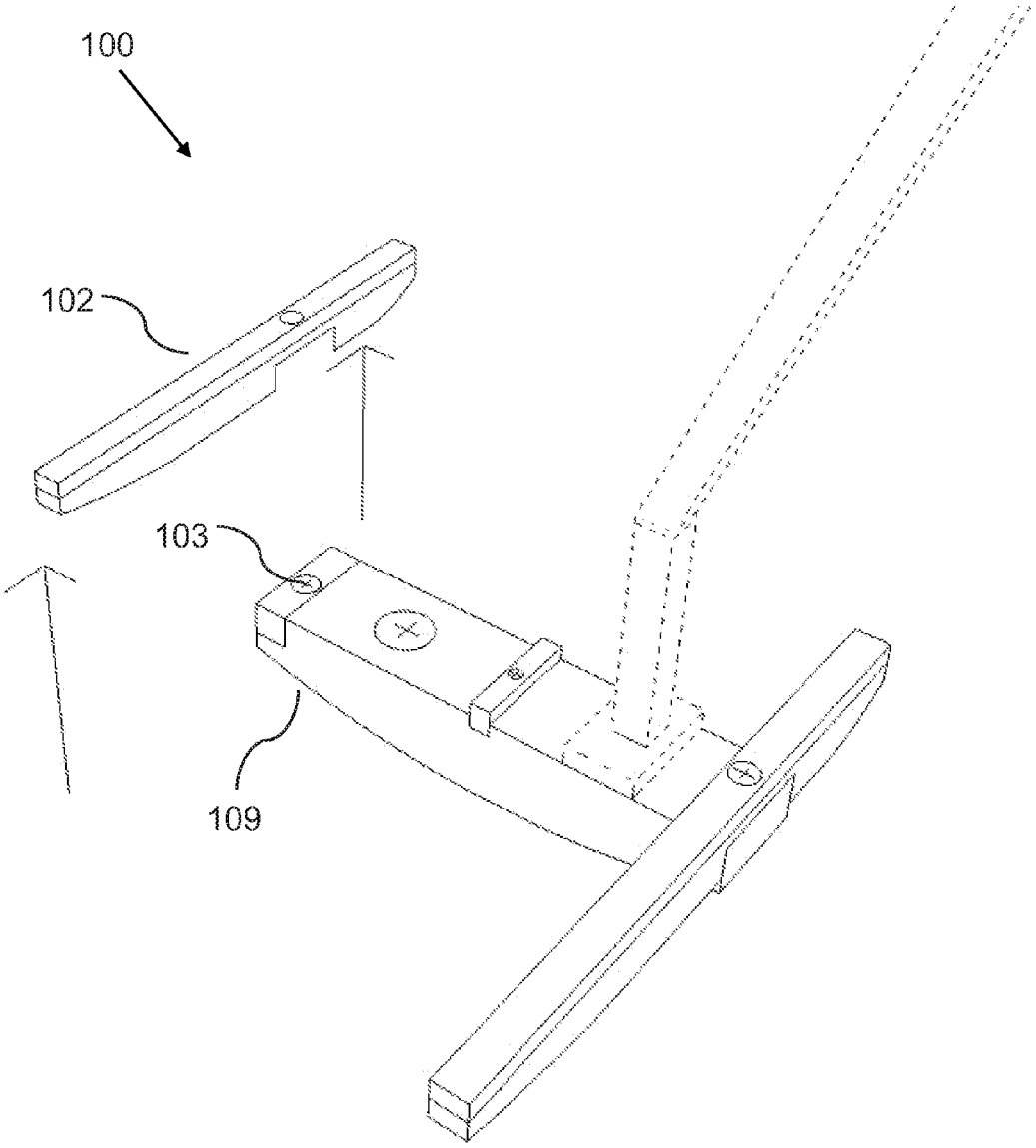
FIG. 3 depicts a top perspective view of an embodiment of the adaptable training putter head with the toe mounted alignment bar detached.

FIG. 3 shows an embodiment of the adaptable training putter head where the toe mounted alignment guide 102 can be detached from the standard putting head 109. For this usage, the fastening mechanism can be retained in position on the standard putting head 109.

Figure 4:
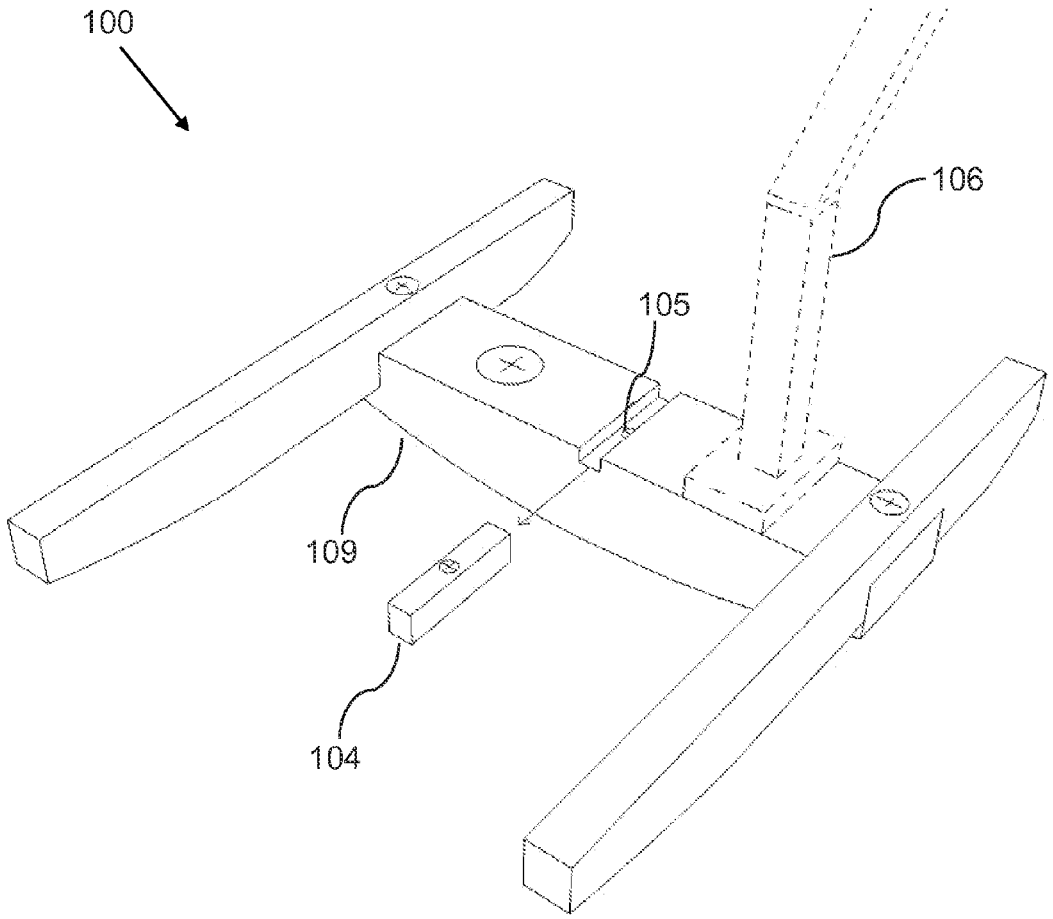
FIG. 4 depicts a top perspective view of an embodiment of the adaptable training putter head with the sighting bar detached.

FIG. 4 shows an embodiment of the adaptable training putter head in which the sighting bar 104 can be detached from the standard putting head 109, with its fastening mechanism 105 retained in the standard putting head 109.

Figure 5:
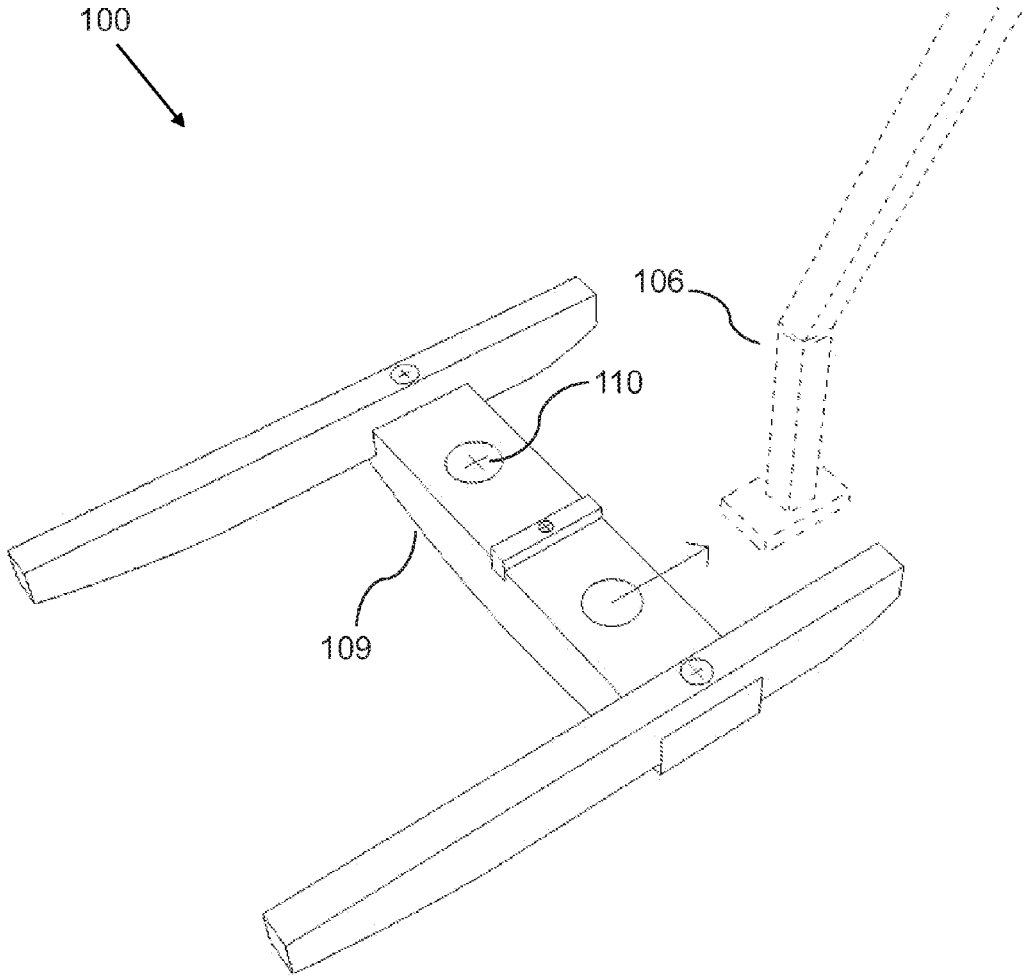
FIG. 5 depicts a top perspective view of an embodiment of the adaptable training putter head with the hosel detached.

FIG. 5 shows an embodiment of the adaptable training putter head 100 in which the hosel 106 can be detached, via release of fastener 201 (FIG. 2), from the standard putting head 109 in order to be repositioned for left-hand use configuration on the opposite side of the putter head at the position of the alternative fastening aperture 110, and fastened with fastener 202 (FIG. 2), or alternatively with fastener 201 (FIG. 2) relocated to the position of fastener 202 (FIG. 2).

Figure 6:
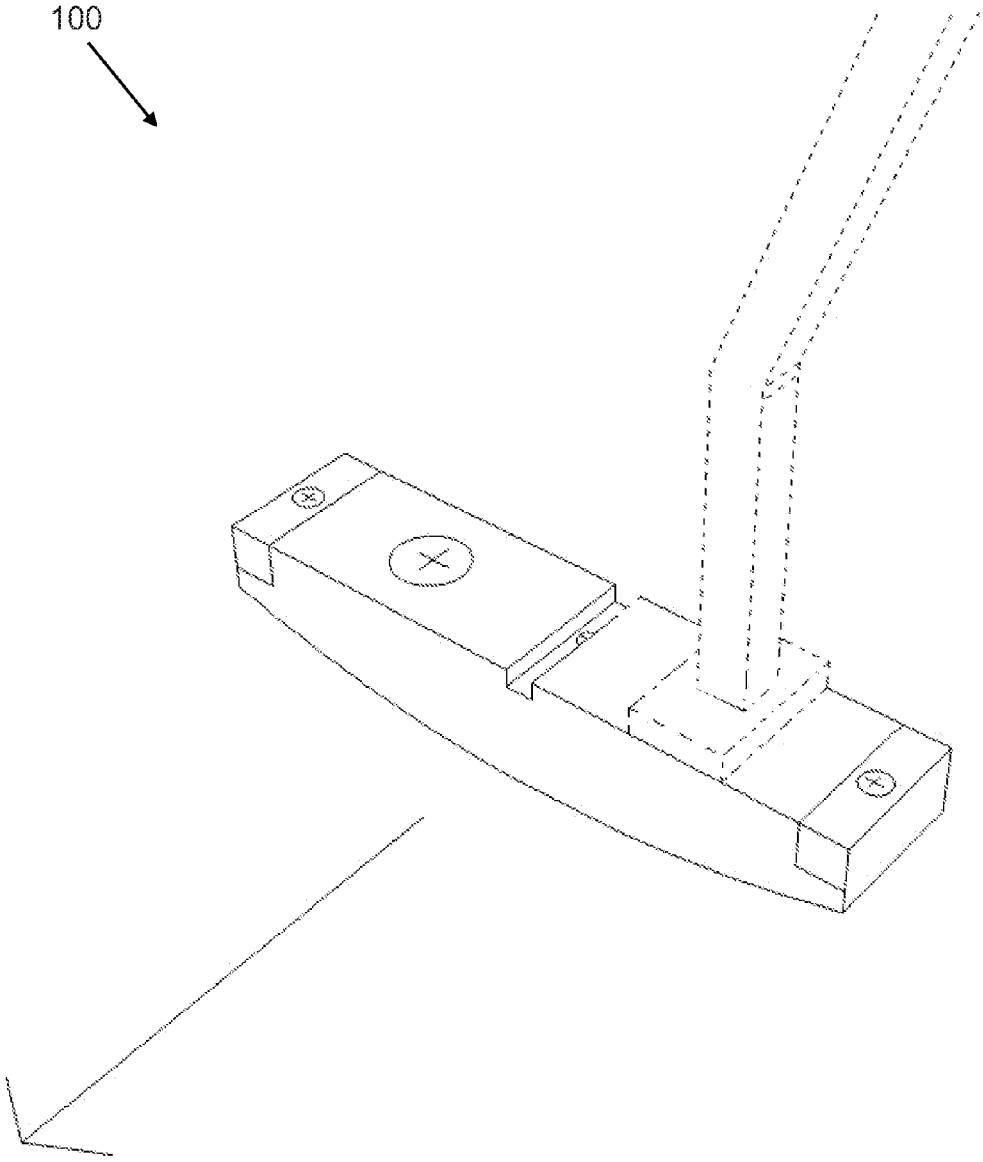
FIG. 6 depicts a top perspective view of an embodiment of the adaptable training putter head with the alignment bars and sighting bar detached.

FIG. 6 shows an embodiment of the adaptable training putter head 100, in a configuration with alignment guides and sighting bar detached, so that the adaptable training putter head 100 can be configured to be regulation conformant.

In various embodiments, the adaptable training putter head 100 can include one toe mounted alignment guide 102, or one heel mounted alignment guide 108, or one sighting bar 104, or any combination of these elements.

In a related embodiment, the adaptable training putter head 100 can include only one outer alignment guide 102, such that the outer alignment guide 102 is center mounted, such that the alignment guide 102, is mounted at in the center or substantially close to the center of the standard putting head 109, and further configured such that it does not interfere with a golf ball during a putting stroke.

In an embodiment, the standard putting head 109 can be made of a solid or machined hard durable material, such as for example a metal alloy. The toe and heel alignment guides 102, 108 and the sighting bar 104 can be made of the same material, or a material with similar characteristics.

In a related embodiment, the standard putting head 109 can be made of a steel alloy, and inner and outer alignment guides 102, 108 and the sighting bar 104 can be made of an aluminum alloy.

In a further related embodiment, the alignment guides 102, 108 can be fully or partially hollow, in order to reduce weight and balance the club.

In a yet further related embodiment, the standard putting head 109 can be hollow, in order to reduce weight and balance the club.

Figure 9:
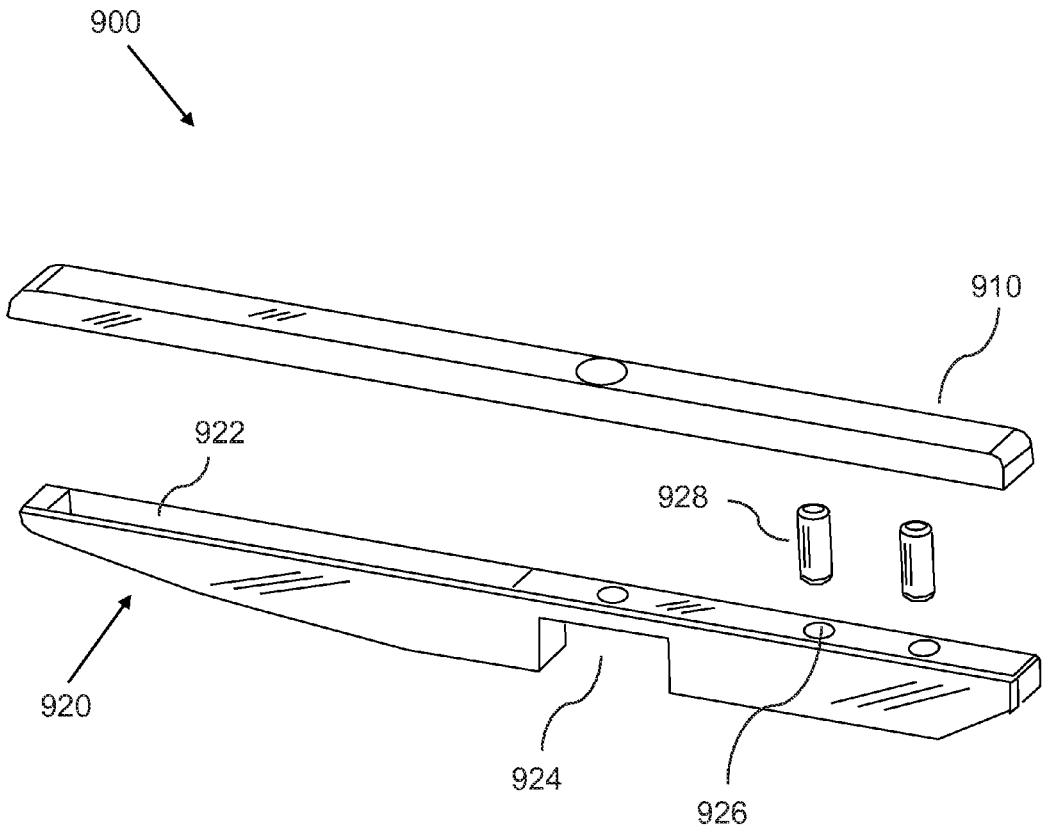
FIG. 9 depicts a perspective view of an alignment guide, according to an embodiment of the invention.

In an embodiment, illustrated in FIG. 9, an alignment guide 900, such as an inner our outer alignment guide 102, 108, can comprise of:

a. An upper body 910;

b. A lower body 920, such that the top of the lower body 920 can be covered by the upper body 910, wherein the lower body 920, can further comprise:

i. an alignment guide cavity 922, which partially hollows the lower body 920, and can be positioned in the front part of the lower body 920;

ii. an alignment guide cutout 924, which forms a shape to fit around the upper part of a standard putting head 109;

iii. at least one weight cavity 926;

iv. at least one alignment guide weight 928, which can be inserted in the weight cavity 926 in order to configure the balance of the adaptable training putter head 100.

In a further embodiment, the top half, a part of, or the entirety of the alignment guides 102, 108, and the entire sighting bar 104 can be made of the same or similar material, but manufactured in a visually contrasting manner, such as for example with a dissimilarly colored but durable metal alloy, or by a coating with a bright and contrasting color.

In a further embodiment, the alignment guides 102, 108 may be bottom mounted, to be either flush with or underneath the underside of the standard putting head 109. The alignment guides are shown top mounted in FIGS. 1-5.

In a further embodiment, the alignment guides 102, 108 may be side mounted, mounted to the heel or toe side surface of the standard putting head 109.

In a further embodiment, the alignment guides 102, 108 may be reverse mounted, so that the majority or the entirety of the alignment guides protrude in the backward direction, as compared to the direction of a putting stroke motion, from the standard putting head 109. The alignment guides are shown protruding in majority in the forward direction on FIGS. 1-5.

In a related embodiment, the fastening mechanisms 103, 107 for the alignment guides 102, 108 can allow for these guides to be secured at varying distances from the center of the standard putting head 109 face, so that at closer distances there is less clearance room beside the golf ball, and correlated with this less club face surface area to allow for deviation from the perfect line, whereby the tighter spacing forces the golfer to develop a higher degree of control during the putting stroke.

Figure 7:
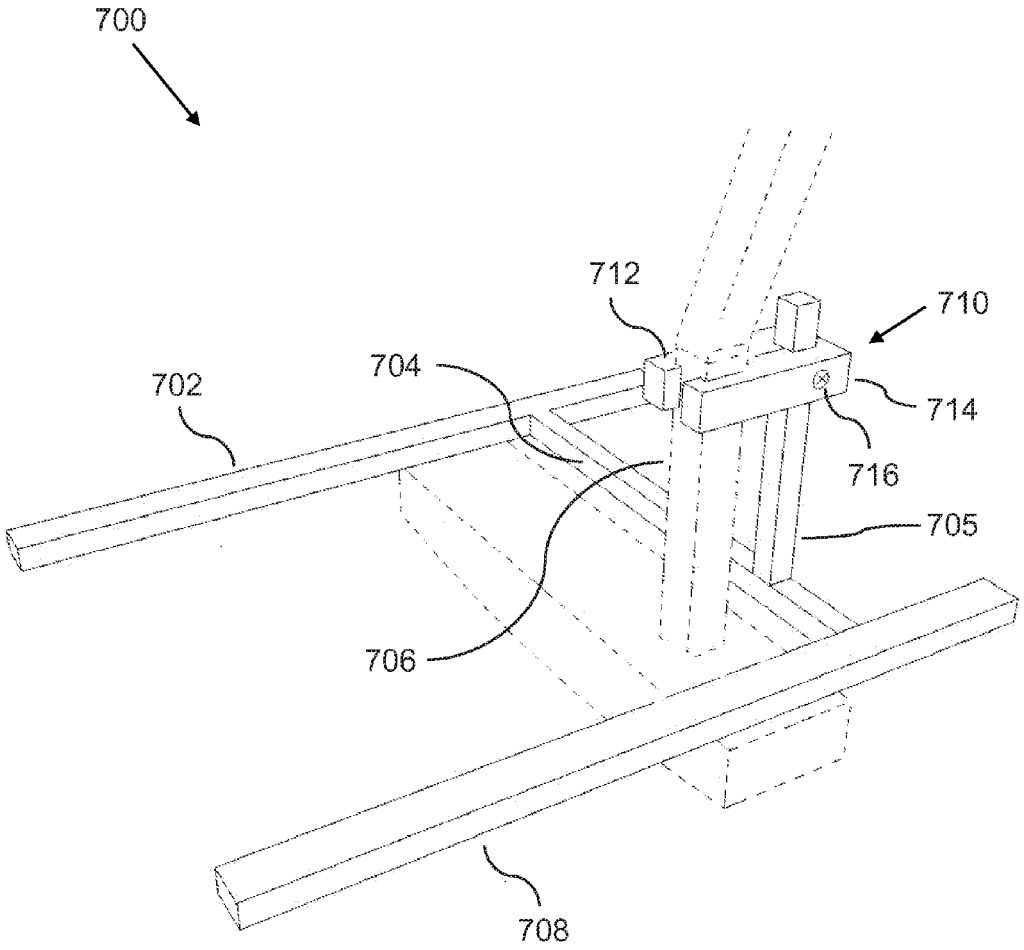
FIG. 7 depicts a perspective view of a golf putter training clip-on device with elongator, according to an embodiment of the invention.

In an embodiment, a golf putter training clip-on device 700, as illustrated in FIG. 7, can comprise:

a) An outer alignment guide 702;

b) An inner alignment guide 708;

c) A bridge 704; wherein i. the outer alignment guide 702 is connected to the outer end of the bridge 704;

ii. the inner alignment guide 708 is connected to the inner end of the bridge 704;

iii. such that the bridge 704 connects between the outer and inner alignment guides 702, 708;

d) An elongator 705; wherein the elongator 705 is connected to the bridge 704, such that the elongator 705 projects upwards from the bridge 704;

e) A clip 710;

wherein the clip 710 can attach the clip-on device 700 to a standard golf putter by being clipped on to a hosel 706 of the standard golf putter;

such that the position of the clip 710 on the elongator 705 and the hosel 706 can adjust the position and height of the outer alignment guide 702, the inner alignment guide 708, and the bridge 704; such that the inner and outer alignment guides are perpendicular to the face of the standard putting head, pointing in the putting target direction;

whereby a golf player can adjust proper putter alignment throughout an entire putting stroke, by ensuring that the outer and inner alignment guides 702, 708 are pointed in the intended putting target direction.

In a related embodiment:

a) the outer alignment guide 702 can connected to the outer end of the bridge 704, such that the outer alignment guide is substantially perpendicular to the bridge 704;

b) the inner alignment guide 708 can connected to the inner end of the bridge 704, such that the inner alignment guide 708 is substantially perpendicular to the bridge 704;

In a related embodiment, the elongator 705, can project upwards from the bridge, substantially parallel to the hosel 706.

In an embodiment, the clip 710 can further comprise:

a) an outer clip arm 712;

b) an inner clip arm 714;

c) a clip fastener 716; which can be tightened such that the outer and inner clip arms 712, 714 tighten around the hosel 706; to secure the clip 710 in place on the hosel 706, thereby securing the golf putter training clip-on device 700 in place on the standard golf putter.

Figure 8:
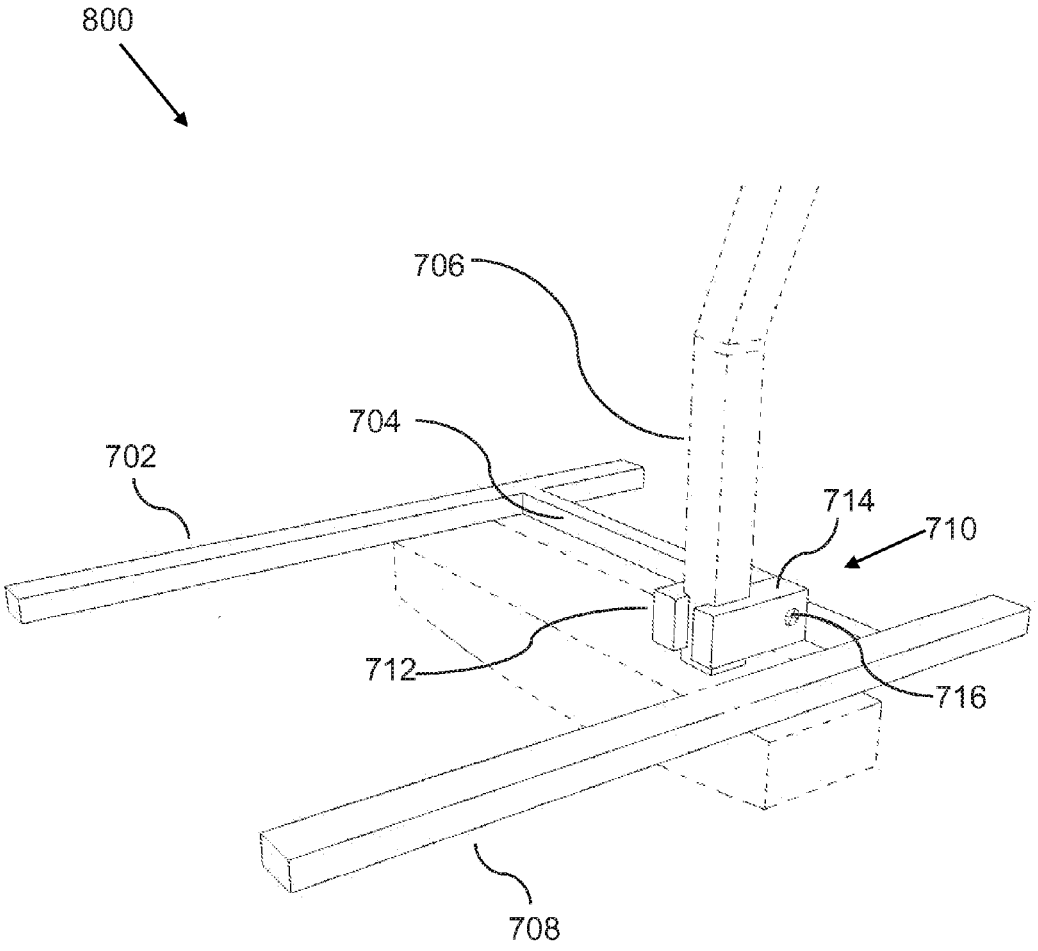
FIG. 8 depicts a perspective view of a golf putter training clip-on device without an elongator, according to an embodiment of the invention.

In a related alternative embodiment without an elongator, a golf putter training clip-on device 800, as illustrated in FIG. 8, can comprise:

a) An outer alignment guide 702;

b) An inner alignment guide 708;

c) A bridge 704; wherein the outer alignment guide 702 is connected to the outer end of the bridge 704, such that the outer alignment guide is perpendicular to the bridge 704;

the inner alignment guide 708 is connected to the inner end of the bridge 704, such that the inner alignment guide 708 is perpendicular to the bridge 704;

such that the bridge 704 connects between the outer and inner alignment guides 702, 708;

d) A clip 710;

Wherein the clip 710 is connected to the bridge 704, and the clip 710 can attach the clip-on device 800 to a standard golf putter by being clipped on to a hosel 706 of the standard golf putter;

such that the position of the clip 710 on the hosel 706 can adjust the height of the outer alignment guide 702, the inner alignment guide 708, and the bridge 704; such that the inner and outer alignment guides are perpendicular to the face of the standard putting head, pointing in the putting target direction;

whereby a golf player can adjust proper putter alignment throughout an entire putting stroke, by ensuring that the outer and inner alignment guides 702, 708 are pointed in the intended putting target direction.

In various related embodiments, the clip 710 can employ a plurality of designs, all of which can rely on well-known mechanisms and designs. In an related example embodiment, the outer and inner clip arms 712, 714 can be pivotally connected in the rear ends; such that a clasp can connect them on the front ends; whereby the clasp can be used to tighten the outer and inner clip arms 712, 714 around the hosel 706.

Here has thus been described a multitude of embodiments of the adaptable training putter head, which can be employed in numerous modes of usage. Particularly, embodiments of the adaptable training putter head can function as a training putter, whereby it can be used as a method for improving accuracy during the putting phase of the golf game. Also, embodiments of the adaptable training putter head can function as a conventional putter for both non-regulation conforming recreational and regulation conforming competitive usage.

The many features and advantages of the invention are apparent from the detailed specification, and thus, it is intended by the appended claims to cover all such features and advantages of the invention, which fall within the true spirit and scope of the invention.

Many such alternative configurations are readily apparent, and should be considered to be fully included in this specification and the claims appended hereto. Accordingly, since numerous modifications and variations will readily occur to those skilled in the art, it is not desired to limit the invention to the exact construction and operation illustrated and described, and thus, all suitable modifications and equivalents may be resorted to, falling within the scope of the invention.

What is claimed is:

1. An adaptable training putter head for use in a training putter, comprising:

a) a putting head; and b) a first alignment guide; wherein the first alignment guide is secured with a first fastening mechanism to the putting head; such that a direction of the first alignment guide is in an intended putting target direction, perpendicular to a front face of the putting head;

wherein the first alignment guide further comprises at least one first weight cavity and a first alignment guide weight, such that the first alignment guide weight is configured to be insertable in the first weight cavity;

wherein the first alignment guide further comprises a first upper body and a first lower body, which are configured such that a top of the first lower body is entirely covered by the first upper body;

wherein the first lower body further comprises the at least one first weight cavity;

whereby a golf player can adjust proper putter alignment throughout an entire putting stroke, by ensuring that the first alignment guide is pointed in the intended putting target direction;

whereby a weight of the adaptable training putter head can be adapted and a balance of the adaptable golf putter head can be improved.

2. The adaptable training putter head of claim 1, further comprising:

a second alignment guide; wherein the second alignment guide is secured with a second fastening mechanism to the putting head; such that the direction of the second alignment guide is in the putting target direction, perpendicular to the front face of the putting head.

3. The adaptable training putter head of claim 2, wherein the first alignment guide and the second alignment guide are detachable.

4. The adaptable training putter head of claim 2, wherein the first alignment guide is toe mounted and the second alignment guide is heel mounted.

5. The adaptable training putter head of claim 2, wherein the second alignment guide further comprises a second upper body and a second lower body, which are configured such that the second lower body is entirely covered by the second upper body.

6. The adaptable training putter head of claim 2, wherein the first and second alignment guides each further comprise an alignment guide cavity, whereby the weight of the adaptable training putter head can be reduced and balance of the adaptable golf putter head can be improved.

7. The adaptable training putter head of claim 2, wherein the second alignment guide further comprises at least one second weight cavity, which is configured to receive a second alignment guide weight.

8. The adaptable training putter head of claim 2, wherein the first and second alignment guides are top mounted.

9. The adaptable training putter head of claim 8, wherein the fastening mechanisms for the alignment guides are configured to allow for the alignment guides to be secured at a plurality of distances from the center of the face of the putting head;

whereby at closer distances there is less clearance room beside a golf ball, and correlated with this less putter head face surface area to allow for deviation from the perfect putting line, such that the tighter spacing forces the golf player to develop a higher degree of control during the putting stroke.

10. The adaptable training putter head of claim 1, further comprising:

a fastening aperture, wherein the fastening aperture is configured such that a hosel of a golf putter can be mounted in the fastening aperture, and secured in place with a bottom mounted fastening mechanism;

whereby the adaptable training putter head can be used by the golf player in a right-handed configuration.

11. The adaptable training putter head of claim 1, further comprising:

a sighting bar, which is attached to the golf putter head and secured with a second fastening mechanism;

whereby the sighting bar can help the golf player position the putter head correctly behind a golf ball, and further allow the golf player to visually confirm a direction of an intended putt, before and during a putting stroke.

12. The adaptable training putter head of claim 1, wherein the first alignment guide is side mounted.

13. A training clip-on device for golf putting, comprising:

a) at least one alignment guide;

b) a bridge; wherein the alignment guide is connected to the bridge;

c) an elongator, such that the elongator projects upwards from the bridge; and d) a clip, wherein the clip is connected to the elongator;

wherein the at least one alignment guide further comprises:

an outer alignment guide, wherein the outer alignment guide is connected to a first end of the bridge; and an inner alignment guide, wherein the inner alignment guide is connected to a second end of the bridge;

wherein the clip is configured to attach the training clip-on device to a golf putter by being clipped on to a hosel of the golf putter and on to the elongator; such that a position of the clip on the hosel and the elongator is configurable to adjust a position and height of the at least one alignment guide and the bridge; such that further the at least one alignment guide is configurable to be perpendicular to a face of a putting head of the golf putter, thereby pointing in an intended putting target direction;

whereby a golf player can adjust proper putter alignment throughout an entire putting stroke, by ensuring that the at least one alignment guide is pointed in the intended putting target direction.

14. The training clip-on device of claim 13, wherein the outer alignment guide is substantially perpendicular to the bridge;

and the inner alignment guide is substantially perpendicular to the bridge.

15. The training clip-on device of claim 13, wherein the inner alignment guide, the outer alignment guide, and the elongator are hollow.

16. A training clip-on device for golf putting, comprising:

a) at least one alignment guide;

b) a bridge; wherein the at least one alignment guide is connected to the bridge, such that the at least one alignment guide is perpendicular to the bridge;

such that the bridge connects to the at least one alignment guide; and c) a clip;

wherein the at least one alignment guide further comprises:

an outer alignment guide, wherein the outer alignment guide is connected to a first end of the bridge; and an inner alignment guide, wherein the inner alignment guide is connected to a second end of the bridge;

wherein the inner alignment guide and the outer alignment guide are hollow;

wherein the clip is connected to the bridge, and wherein further the clip is configured to attach the training clip-on device to a golf putter by being clipped on to a hosel of the golf putter;

such that a position of the clip on the hosel is configurable to adjust a height of the at least one alignment guide and the bridge; such that the at least one alignment guide is configurable to be perpendicular to a face of a putting head of the golf putter, thereby pointing in an intended putting target direction;

whereby a golf player can adjust proper putter alignment throughout an entire putting stroke, by ensuring that the at least one alignment guide is pointed in the intended putting target direction.

17. The training clip-on device of claim 16, wherein the outer alignment guide is substantially perpendicular to the bridge;

and the inner alignment guide is substantially perpendicular to the bridge.

18. The training clip-on device of claim 16, wherein the training clip on device is configured such that the bridge is behind a rear plane of the putter head, when the clip is attached to the hosel.

* * * * *